US008851543B2

(12) United States Patent
Kostecki

(10) Patent No.: US 8,851,543 B2
(45) Date of Patent: Oct. 7, 2014

(54) REVERSIBLE LIFTING LUG

(71) Applicant: Alloy Steel Australia (INT) Pty Ltd, Malaga (AU)

(72) Inventor: Gene Kostecki, Malaga (AU)

(73) Assignee: Alloy Steel Australia (INT) Pty Ltd, Malaga (AU)

( * ) Notice: Subject to any disclaimer, the term of this patent is extended or adjusted under 35 U.S.C. 154(b) by 0 days.

(21) Appl. No.: 14/172,596

(22) Filed: Feb. 4, 2014

(65) Prior Publication Data

US 2014/0212211 A1 Jul. 31, 2014

(30) Foreign Application Priority Data

Jan. 11, 2013 (AU) ..... 2013900085

(51) Int. Cl.
*B66F 19/00* (2006.01)
*B66C 1/10* (2006.01)

(52) U.S. Cl.
CPC ..... *B66C 1/10* (2013.01)
USPC ..... 294/215; 294/82.1

(58) Field of Classification Search
CPC ..... B66C 1/66; E04G 21/142; B60P 7/0807
USPC ..... 294/215, 82.1, 89; 410/102, 101
See application file for complete search history.

(56) References Cited

U.S. PATENT DOCUMENTS

| | | | | |
|---|---|---|---|---|
| 2,748,646 | A * | 6/1956 | Harold et al. | 411/389 |
| 3,795,420 | A * | 3/1974 | Preston, Jr. | 294/90 |
| 5,775,664 | A * | 7/1998 | Martin | 248/500 |
| 5,823,588 | A * | 10/1998 | Morghen | 294/89 |
| 8,662,556 | B2 * | 3/2014 | Hagenbuch | 294/215 |
| 2010/0266333 | A1 * | 10/2010 | Oswald et al. | 403/164 |
| 2011/0109106 | A1 * | 5/2011 | Inda | 294/1.1 |
| 2013/0082477 | A1 * | 4/2013 | Fuller et al. | 294/215 |
| 2014/0042763 | A1 * | 2/2014 | Alba | 294/215 |

* cited by examiner

*Primary Examiner* — Saul Rodriguez
*Assistant Examiner* — Gabriela Puig
(74) *Attorney, Agent, or Firm* — R. Neil Sudol; Henry D. Coleman

(57) ABSTRACT

A lug reversibly connectable to a wear plate having a hole extending therethrough. The lug includes a coupling means and a plug. The plug comprises an upper surface. In a first position the lug is connectable to an underside of the wear plate such that the coupling means extends through said hole and outward from an upper surface of the wear plate an in this position can be engaged by a hoist. In a second position the lug is connectable to the underside of said wear plate such that the plug fills said hole whereby the upper surface of the plug is aligned with the upper surface of the wear plate to thereby present an even wear surface.

16 Claims, 8 Drawing Sheets

REVERSIBLE LIFTING LUG

FIELD OF THE INVENTION

The present invention relates generally to lifting lugs for wear liners and in one aspect relates to a lug that can be reversibly mounted to a wear plate.

BACKGROUND OF THE INVENTION

Wear plates may be used for numerous applications to protect an underlying surface or to protect a material being handled. Wear plate may be constructed from a uniform material, such as a chromium or tungsten alloy, or the plate may be asymmetric and comprise a layer of alloy, rubber, ceramic or polyurethane that overlays a steel plate.

The wear plate may include an upper surface that provides a generally continuous and smooth sliding surface to enhance the sliding of material thereover and reduce hangup of the material.

The wear plate may comprise a layer of hard surfaced alloy over a mild steel base. It is the hard faced surface of the wear plate which contacts the material being handled and over which the material slides during loading or unloading. Wear resistant plates are used in areas where there is likely to be a high degree of abrasion, such as buckets, chutes and hoppers used in mining or earthmoving equipment. The use of wear resistant plates increases the working life of the machinery or bulk handling equipment, because the plates inhibit wear and can be replaced at any stage to protect the underlying surface.

In some applications the upper surface of the wear plate may comprise a layer of ceramic material. In still other applications, the upper surface may be constructed from rubber or polyurethane to provide a non-rigid or pliable load-bearing surface.

In all applications it is important that the wear plate provides a generally smooth upper surface to inhibit increased abrasion by the material being handled. Irregularities in the upper surface of the plate such as bolt heads extending out therefrom or hollows, leads to an increase in localised turbulence, which can result in damage to the wear plate thereby reducing its life span, or damage to the material being handled.

Where large areas are clad, including hoppers and chutes used in handling ore and rock in the mining industry, the plates are sizable and need to be moved by a hoist, such as a crane, during installation and replacement. These large wear resistant plates therefore require an engagement device for connecting to the hoist. Since the underside of the plates is attached to the hopper or chute the coupling means must be positioned adjacent the outer or upper surface of the plate, which can result in irregularities in the upper surface.

An engagement device can be detachably connected to the outer surface of the wear plate using bolts that engage apertures through the wear resistant plate. However this results in holes or depressions that during use can cause hangup of material or generally increase localised wear of the plate. Likewise permanently fixed lugs result in irregularities in the outer surface that can result in increased abrasion or damage to the material being handled.

The term wear plate used throughout the specification defines any plate or panel that is used to provide a wear lining. In one form the invention can be used on plates having a backing that has been hard faced with a suitable hard surfacing alloy. In another form the wear plate may include a layer constructed from rubber, ceramic or polyurethane. Although the invention is discussed with particular reference to hard faced wear plate it should be appreciated that the invention is not limited to this application and the invention could be use in conjunction with rubber lining, ceramic linings or polyurethane linings without departing from the scope of the invention.

It should be appreciated that any discussion of the prior art throughout the specification is included solely for the purpose of providing a context for the present invention and should in no way be considered as an admission that such prior art was widely known or formed part of the common general knowledge in the field as it existed before the priority date of the application.

SUMMARY OF THE INVENTION

It could be broadly understood that the invention resides in a lug reversibly connectable to a wear plate having a hole extending therethrough, the lug includes a coupling means and a plug, said plug comprising an upper surface, wherein in a first position the lug is connectable to an underside of the wear plate such that the coupling means extends through said hole and outward from an upper surface of the wear plate for engagement with a hoist, and in a second position the lug is connectable to the underside of said wear plate such that the plug fills said hole whereby the upper surface of the plug is aligned with the upper surface of the wear plate.

In one form the upper surface of the wear plate is wear resistant and the upper surface of the plug is wear resistant, wherein in said second position the wear resistant upper surface of the plug is aligned with the wear resistant upper surface of the wear plate. The wear resistant upper surfaces may be a hard-faced tungsten layer for use in mining equipment to protect an underlying surface.

In another form the wear plate includes a rubber, ceramic or polyurethane upper layer and the plug includes a corresponding rubber, ceramic or polyurethane upper layer, wherein in said second position the upper surface of the plug is aligned with the upper surface of the wear plate. The rubber or polyurethane lining may be configured to protect the material being handled or to at least provide a pliable load bearing surface.

Preferably the plug substantially fills said hole to thereby provide a generally planar, or at least even, load bearing surface that inhibits abrasion as a material moves thereover.

The plug substantially fills the hole when the lug is in the second position to minimise any irregularities formed in the upper load bearing surface of the wear plate over which the bulk material slides. Irregularities in the upper surface of the wear plate such as ridges and groove can increase the abrasion of the wear plate. Furthermore the irregularities can increase turbulence in the material being handled, which leads to increased abrasion both of the wear plate and within the actual material. This increase in localised abrasion can reduce the lifespan of the wear plate and increase degradation of the material being handled.

In this way the coupling means of the lug can be positioned so that it extends outwardly from the upper surface of the wear plate when the wear plate is being installed or removed from a hopper or chute. Once the wear plate has been installed the lug can be detached, reversed and reattached such that the plug substantially fills the hole to provide a smooth upper surface that inhibits abrasion.

In one form the lug including a base for connection to the underside of the wear plate, the coupling means extending outwardly from a first side of said base, and the plug attached to an opposite side of said base.

The base may include at least two slots or apertures that are configured to engage with fixing means that extend outwardly from the underside of the wear plate. The fixing means may comprise a threaded stud that is connected to the wear plate. The base can be positioned over the threaded studs and a washer and correspondingly threaded nut can be used to hold the lug in position. To remove the lug from the plate the nut or nuts are simply removed.

In this way the lug can be connected in the first or second position and when required the nuts can be removed and the lug reversed and reattached in the required orientation. The nuts can then be reattached to secure the lug relative the wear plate.

The studs may be various studs that are fused to the underside of the wear plate. The working load limit may, in one form, be 2 T per lug.

In one form the base may be a generally planar configuration with the coupling means being welded or otherwise fixed to a first planar side and the plug being welded or otherwise fixed to the opposite second planar side. The base may further include four slots or apertures, spaced apart around the circumference of the base, which are configured to engage with corresponding threaded studs that extend outwardly from the underside of the wear plate. The configuration of the plate, with respect to the slots, is preferably symmetrical whereby the slots or apertures align with the threaded studs when the lug is in the first position or in the second position.

The plug is preferably constructed from the same material as the wear plate so that the plug abrades at the same rate as the wear plate. Both the wear plate and plug may be hard faced with an alloy or may include a rubber, ceramic or polyurethane layer. In one form the plug is cut from the wear plate to form said hole.

In one form the hole in the wear plate is generally circular and the plug is correspondingly shaped to fit therein with minimal gap between the edge of the plug and side of the hole. The use of a circular shape means that the portion of the seam between the hole and plug that is parallel with the direct of travel of the bulk material is reduced to a minimum. The use of such a shape ensures that there is not a significant portion of the seam that is parallel with the direction of travel since this may result in increased abrasion along the seam. Other shapes are however possible, such as an oval, hexagon or a multisided shape having curved sides.

The invention may also be said to reside in a wear plate with at least one reversible lug.

In another form there is proposed a method of positioning a wear plate within a bulk material handling device using a lug, the lug including a coupling means and a plug, the method including the steps of:

attaching the lug to an underside of a wear plate adjacent a hole, wherein the coupling means extends through said hole and outwardly from an upper surface of said wear plate;

attaching a hoist to the coupling means and moving the wear plate so that said underside of the plate is positioned against an inner side of said handling device;

attaching the wear plate to said handling device;

detaching and reversing said lug; and reattaching the lug to said underside of the wear plate wherein the plug substantially fills said hole.

The above method further including the steps of:

detaching and reversing the lug;

reattaching the lug to the underside of the wear plate wherein the coupling means extends through said hole and outwardly from said upper surface of the wear plate; and connecting a hoist to said coupling means and removing the wear plate from said bulk material handling device.

The bulk material handling device may in one form be a mild steel hopper or chute for use in the mining or earthmoving industry.

In this way the lug of the present invention provides a means for lifting the wear plate during installation or replacement, and a means for filling a hole in the wear plate, used for the passage of the coupling means, to thereby inhibit abrasion while the wear plate is installed within the hopper or chute.

BRIEF DESCRIPTION OF THE DRAWINGS

The accompanying drawings, which are incorporated in and constitute a part of this specification, illustrate implementations of the invention and, together with the description, serve to explain the advantages and principles of the invention. In the drawings.

DETAILED DESCRIPTION OF THE ILLUSTRATED AND EXEMPLIFIED EMBODIMENTS

Figure 1:
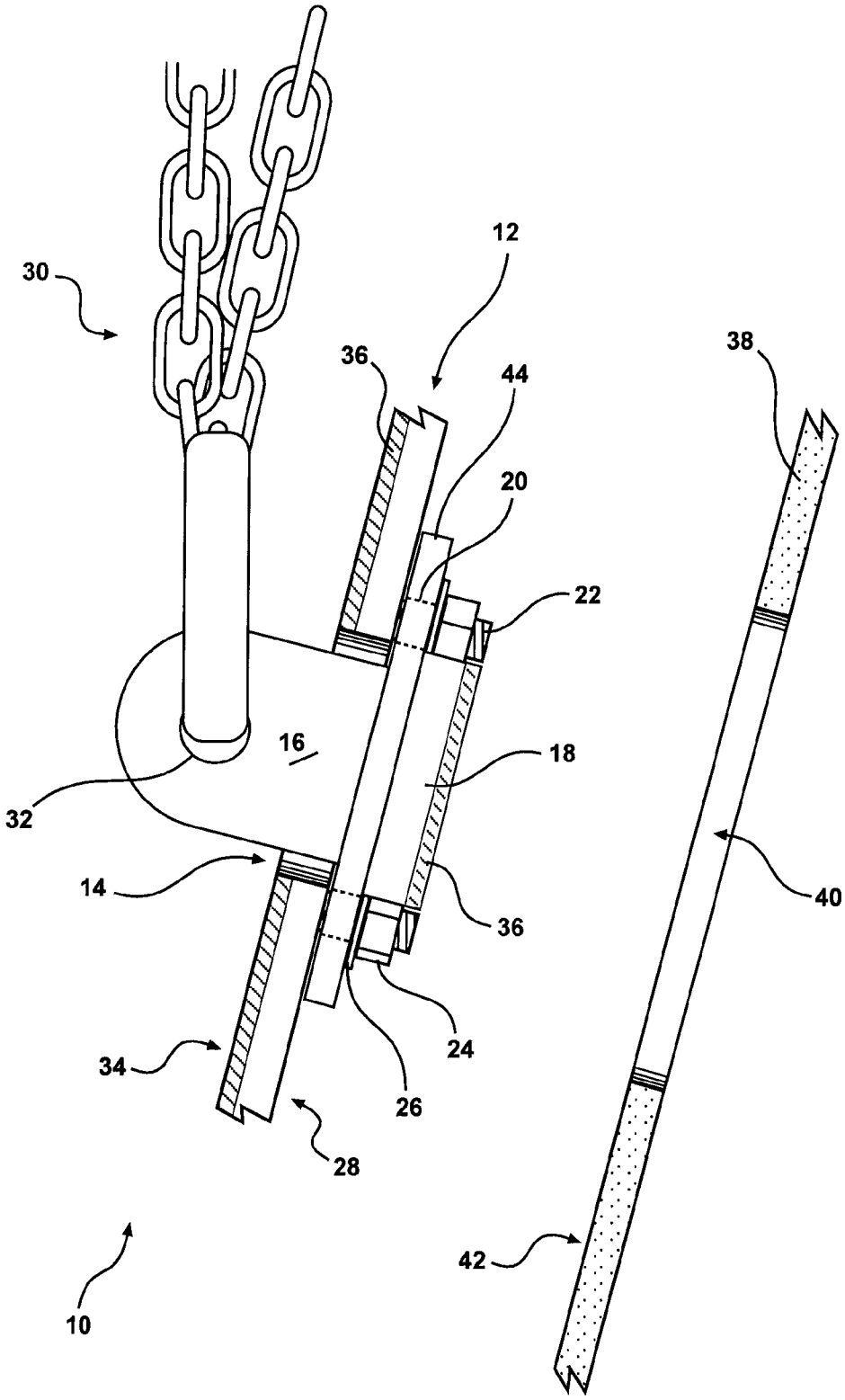
FIG. 1 is a side cross-sectional view of a lug of the present invention attached to a wear plate and coupled to a hoist.

There are numerous specific details set forth in the following description. However, from the disclosure, it will be apparent to those skilled in the art that modifications and/or substitutions may be made without departing from the scope and spirit of the invention. In some circumstance specific details may have been omitted or enlarged so as not to obscure the invention. Similar reference characters indicate corresponding parts throughout the drawings.

Turning to the figures for a detailed explanation of the invention, there is illustrated a lug 10 that can be reversible attached to a wear plate 12 demonstrating by way of an example, an arrangement in which the principles of the present invention may be employed. As illustrated in FIG. 1 the reversible lug 10 can be reversibly connected to the wear plate 12. The plate 12 includes a hole 14 that extends therethrough, and the lug 10 includes a coupling means 16 and plug 18 dimensioned to, in one orientation, substantially fill the hole 14.

The lug 10 includes apertures 20 for engaging threaded studs 22 that extend outwardly from an underside 28 of the wear plate 12. The lug 10 is held in place by a correspondingly threaded nuts 24 with washers 26.

During movement of the wear plate 12 a hoist 30 is connected through aperture 32 of the coupling means 16. The hoist may be a block and tackle chain hoist or any other appropriate hoisting device.

When attached to the wear plate 12 in the first position, as illustrated in FIG. 1, the coupling means 16 extends through said hole 14 and outward from the upper surface 34 of the wear plate 12 for engagement with the hoist 30. In the present example the wear plate 12 is hard faced 36, and likewise the upper surface of the plug is also hard faced 36.

The hopper or chute 38 to which the wear plate is being attached includes an opening 40 through which the lug 10 and nuts 24 can be accessed by a worker.

Figure 2:
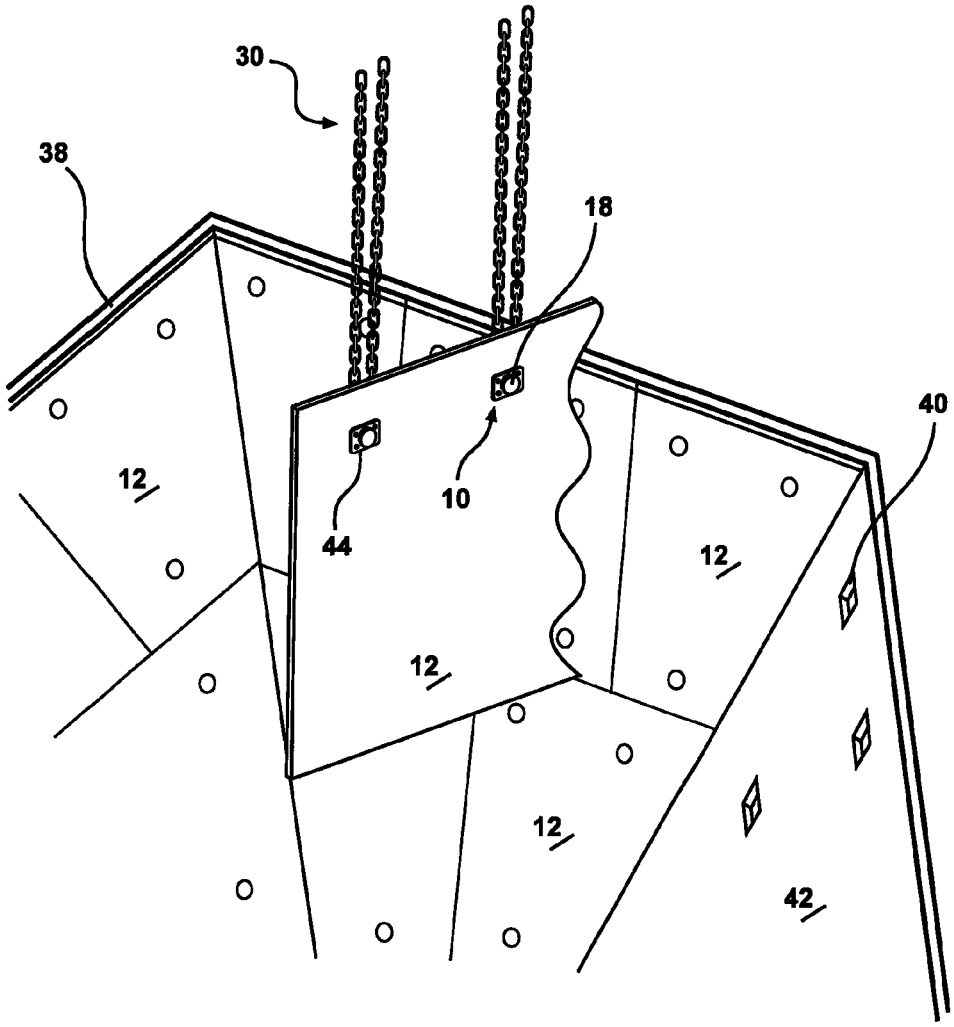
FIG. 2 is a perspective view of the lug of FIG. 1 being used to position the wear plate within a hopper.

The reader will appreciate that a number of lugs may be attached to the wear plate 12 to facilitate lifting thereof, as illustrated in FIG. 2. As further illustrated in FIG. 2 a number of wear plates 12 are attached to the sides of the chute or hopper 38 to provided a replaceable wear resistant liner. The wear plates 12 are attached to the chute or hopper using conventional methods. FIG. 2 illustrates the position of the openings 40 through which the worker can access nuts 24 to fix or release the lug 10.

Figure 3:
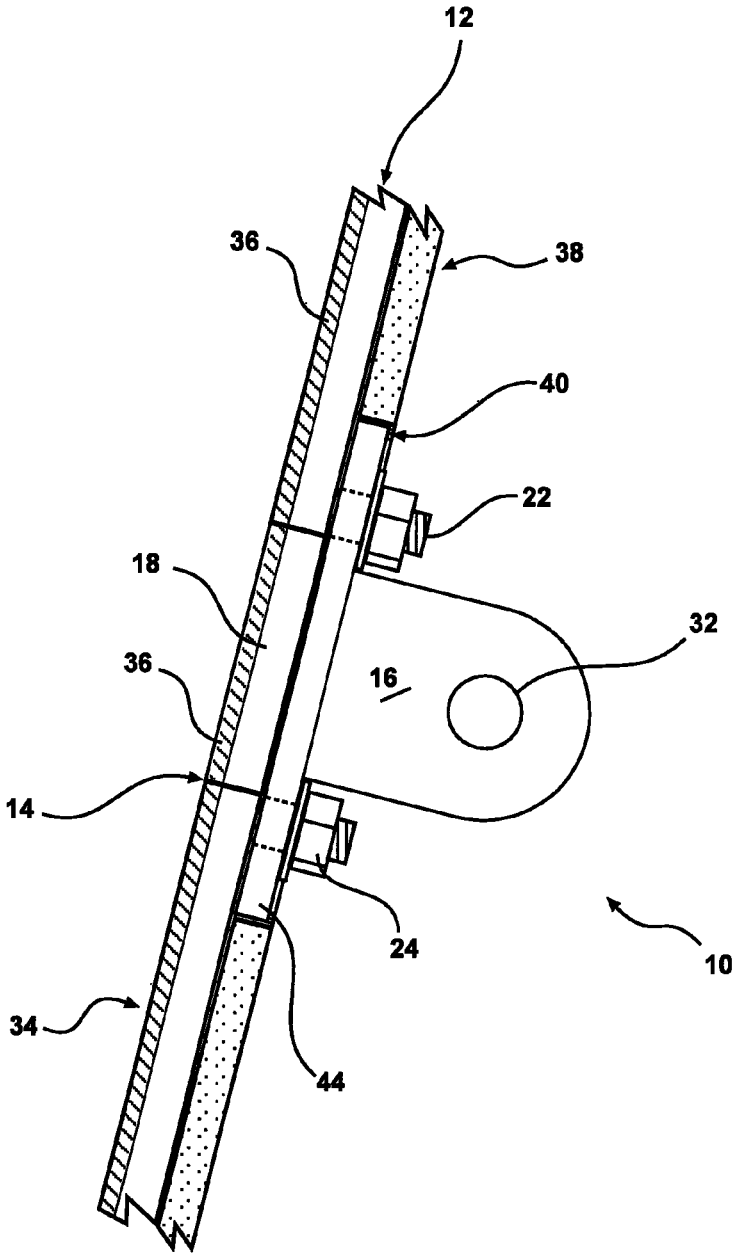
FIG. 3 is a side cross-sectional view of the lug of FIG. 1 in a reversed position to provide a generally smooth upper surface.

Once the wear plate 12 has been positioned within the hopper or chute, such that the underside 28 is positioned against the side of the mild steel hopper or chute 38 the worker can access the nuts to remove the lug 10. The lug 10 is then reversed and reconnect to the underside of the wear plate 12 in a second position, as shown in FIG. 3, such that the plug 18 substantially fills the hole 14. The plug 18 is preferably constructed from the same material as the wear plate 12 so that the plug 18 abrades at the same rate as the plate 12.

The plug 18 substantially fills the hole 14 to thereby provide a generally planar or at least uniform upper surface 34 for inhibiting wear. As the reader will appreciate any irregularities in the upper surface of the wear plate such as ridges and groove can increase the localised abrasion of the wear plate 12 thereby reducing the lifespan of the wear plate.

Figure 4:
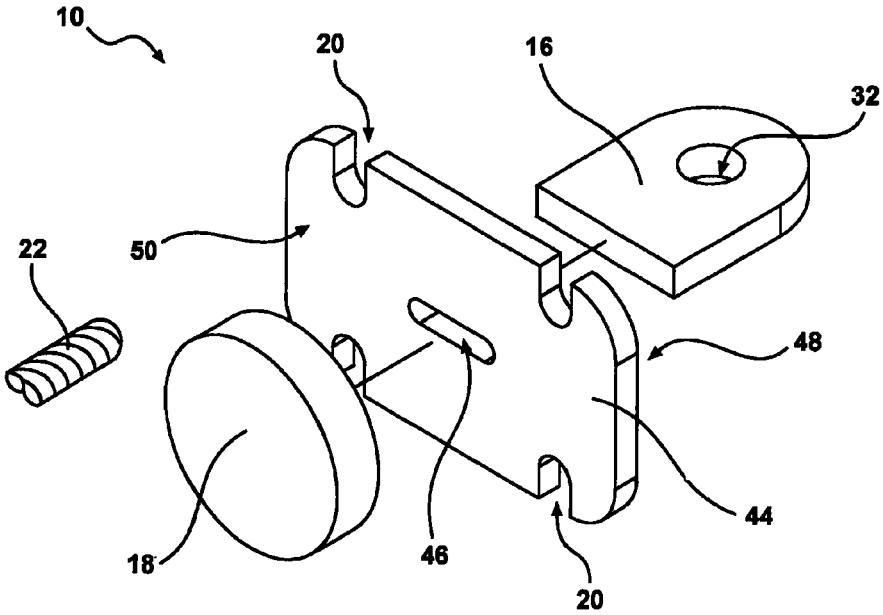
FIG. 4 is an exploded view of one embodiment of the lug.
Figure 5:
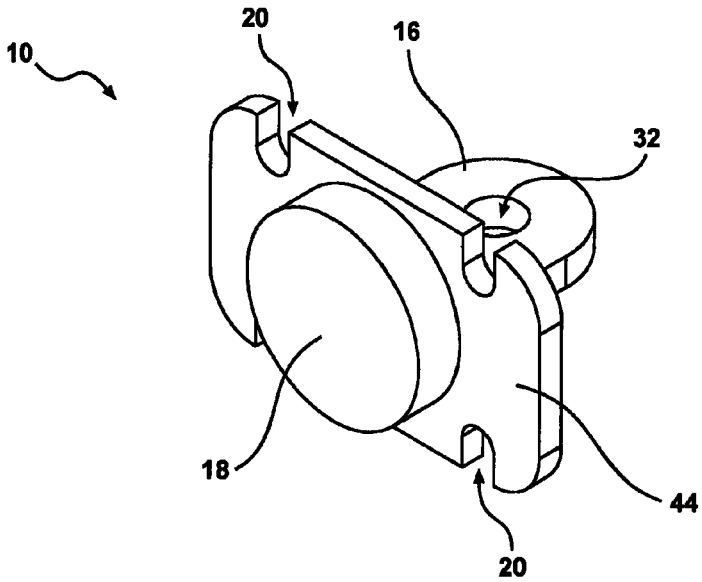
FIG. 5 is a perspective view of the lug of FIG. 4.
Figure 6:
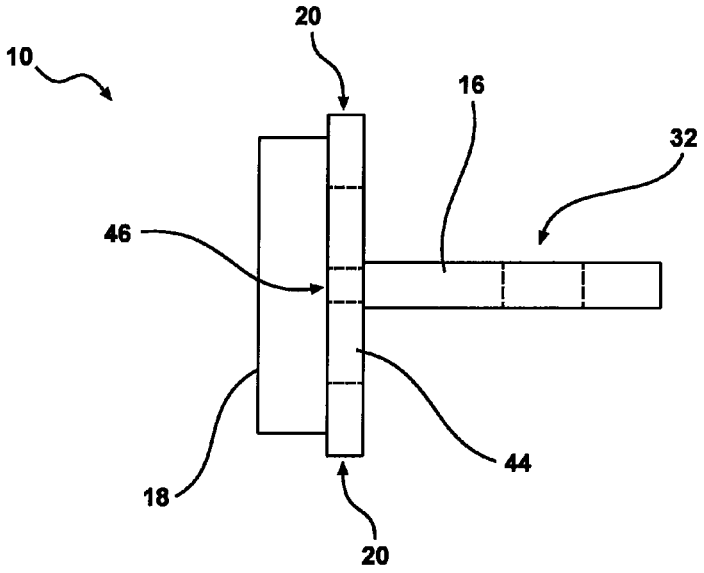
FIG. 6 is a side schematic view of the lug of FIG. 4.
Figure 7:
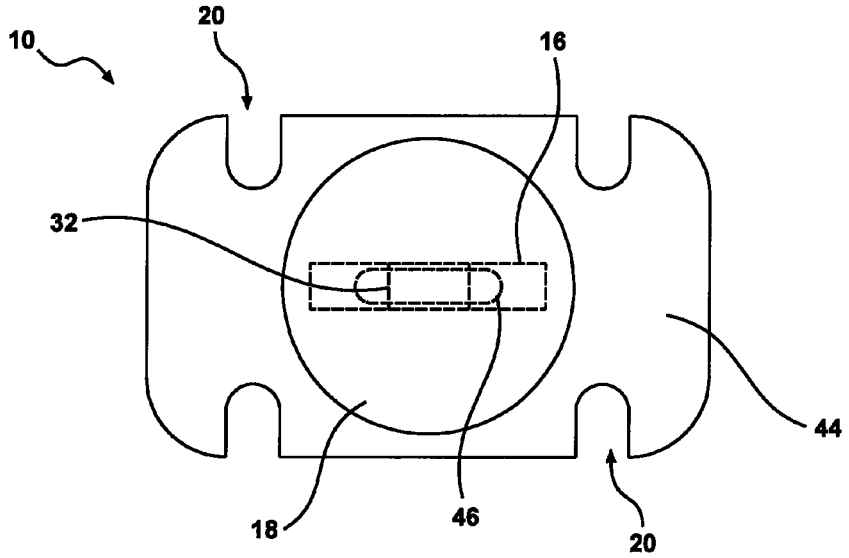
FIG. 7 is an underside schematic view of the lug of FIG. 4.

In one embodiment, as illustrated in FIG. 4, the lug 10 includes a base 44 to which the coupling means 16 and plug 18 are attached by conventional methods, such as welding. The base 44 includes slots or apertures 20 that are configured to engagable with the fixing means 22 that extend outwardly from the underside of the wear plate.

Although it is envisaged that the fixing means will be a threaded stud that is fused to the underside of the wear plate other fixing means are possible without departing from the scope of the invention.

The base 44, as illustrated in FIGS. 4 to 7, has a generally symmetrical planar configuration with a central slot 46. The coupling means 16 are welded or otherwise fixed to a first planar side 48 and the plug 18 being welded or otherwise fixed to the opposite planar side 50. The central slot 46 assists with fixing the coupling means 16 and plug 18. The base 44 of the present embodiment includes four slots or apertures 20, spaced apart around the circumference of the base. The slots or apertures align with the threaded studs when the lug is in the first position or in the second position.

The present invention relates to a reversible lug and a method for attaching the lug to the wear plate in two orientations wherein in the first orientation the wear plate can be lifted by the hoist and in the second orientation a regular or smooth upper surface is presented for movement of the bulk material thereover.

Figure 8A:
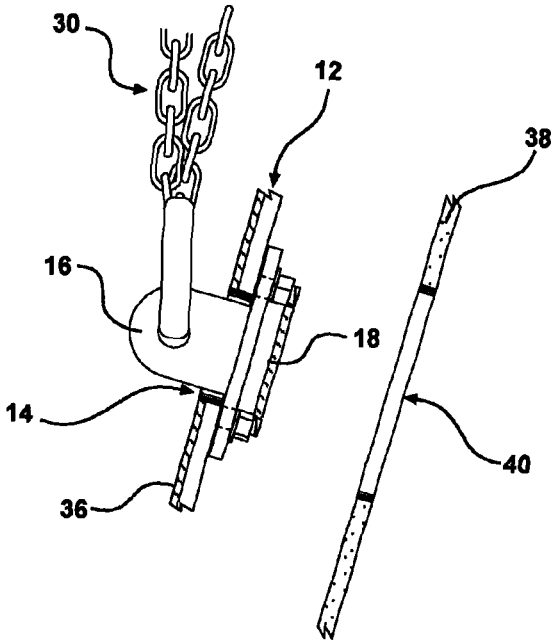
FIG. 8*a* is a side cross sectional view of the lug of FIG. 4, showing the wear plate being lowered into a hopper.
Figure 8B:
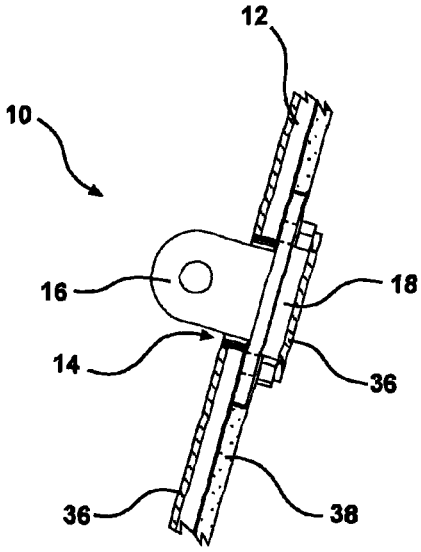
FIG. 8*b* is a side cross sectional view showing the wear plate attached to the hopper.
Figure 8C:
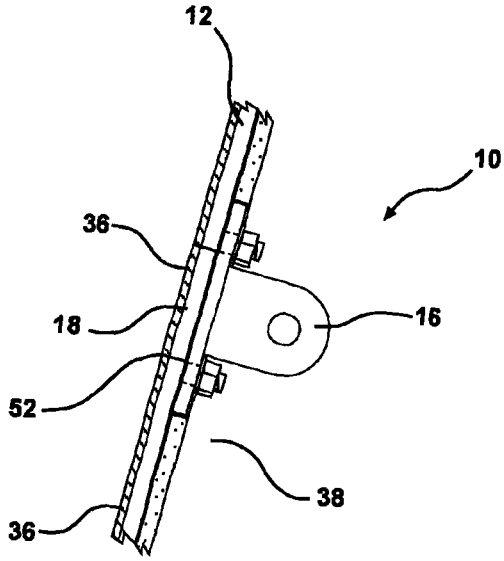
FIG. 8*c* is a side cross sectional view showing the reverse position of the lug.

In another embodiment, as illustrated in FIGS. 8*a* to 8*c*, a method of installing a metallic wear plate 12 within a mild steel hopper or chute 38 using a lug 10 is disclosed. The method includes the steps of: attaching the lug 10 to the underside of wear plate adjacent the hole 14, wherein the coupling means 16 extends through the hole and outwardly from the upper surface 36 of the wear plate 12; a hoist is then connected to the coupling means and the wear plate is moved, as illustrated in FIG. 8*a*, so that the underside of the plate is positioned against the inner side of the hopper or chute 38, as illustrated in FIG. 8*b*; the wear plate is then attached to the hopper or chute and the lug is detaching and reversing; and finally the lug is reattached to the underside of the wear plate wherein the plug substantially fills the hole 14, as illustrated in FIG. 8*c* at 52.

Although not illustrated there is also provided a method of removing the metallic wear plate 12 from the hopper or chute 38. This can be done at any stage when the wear plate has become worn or otherwise damaged.

The method of removing the wear plate 12 is the reverse of the method illustrated in FIGS. 8*a* to 8*c* and includes the steps of: detaching and reversing the lug 10; reattaching the lug to the underside of the wear plate wherein the coupling means 16 extends through the hole 14 and outwardly from the upper surface 36 of the wear plate; and connecting the hoist 30 to the coupling means and removing the wear plate 12 from the hopper or chute 38.

Figure 9:
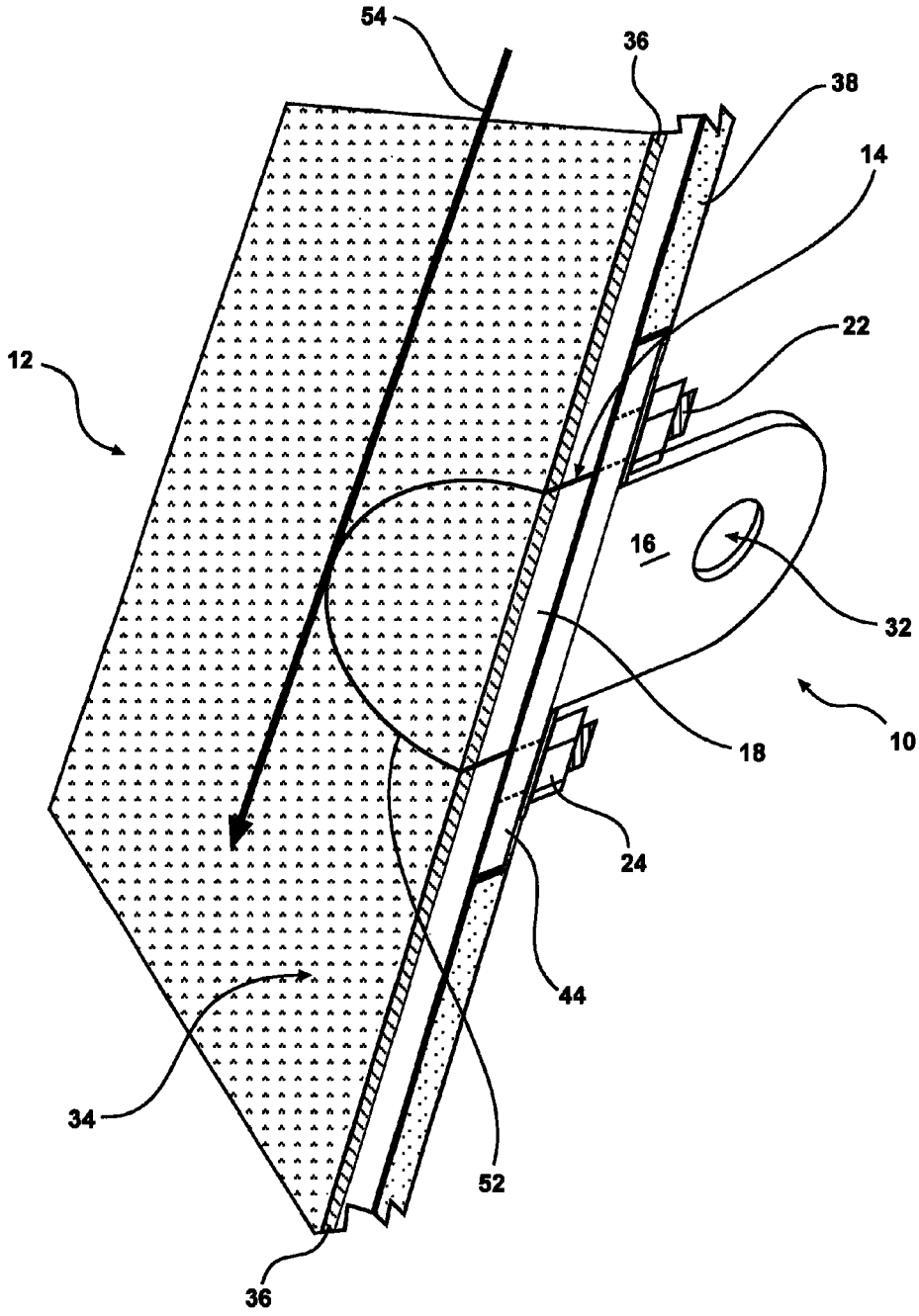
FIG. 9 is a partial perspective view of the upper surface of the wear plate showing the direction of travel of the material over the plug of the lug.

In the present embodiment the hole 14 and corresponding shaped plug 18 are generally circular. The use of a circular shape means that the portion of the seam between the hole and plug that is parallel with the direction of travel of the bulk material is reduced to a minimum. This is illustrated in FIG. 9 wherein the seam or joint between the edge of the hole 14 and plug 18 is indicated by line 52 and the direction of travel of the bulk material is illustrated by arrow 54. The use of such a shape ensures that there is not a significant portion of the seam that is parallel with the direction of travel since this may result in increased abrasion along the seam 52.

Figure 10:
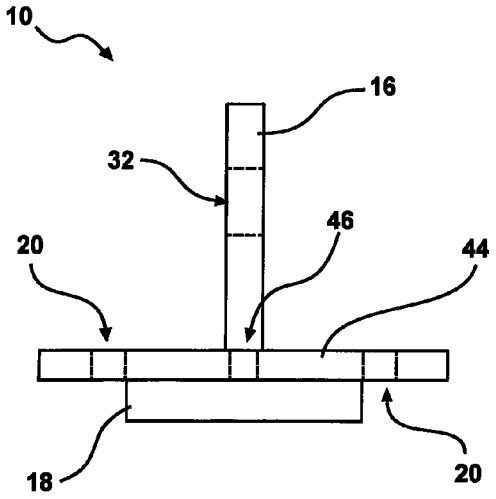
FIG. 10 is a side schematic view of a second embodiment of the lug.
Figure 11:
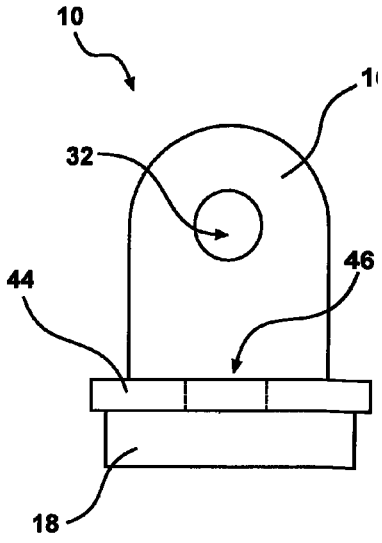
FIG. 11 is an end schematic view of the lug of FIG. 10.
Figure 12:
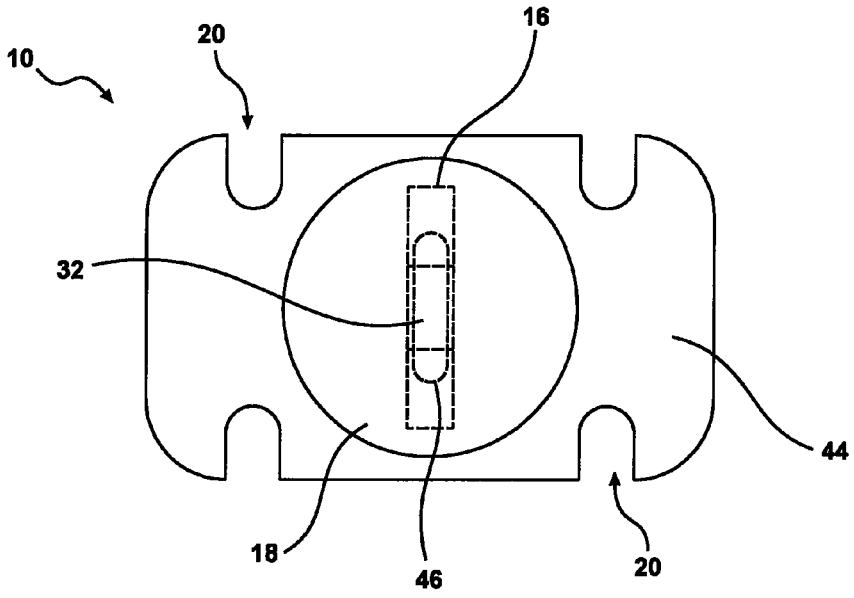
FIG. 12 is an underside schematic view of the lug of FIG. 10.

In a second embodiment, as illustrated in FIGS. 10 to 12 the coupling means 16 is attached to the base 44 wherein the plane of the coupling means 16 is positioned generally lateral and perpendicular to the base 44. Accordingly, in the present embodiment, the central slot 46 that assists with fixing the coupling means 16 and plug 18 to the base is also laterally extending.

The reader should appreciate that the coupling means 16 could be orientated at any angle between the longitudinal position, as illustrated in FIGS. 4 to 7, or the lateral position, as illustrated in FIGS. 10 to 12. Furthermore, the coupling means 16 may be positioned oblique to the surface of the base 44.

The skilled addressee will now appreciate the illustrated invention provides a lug 10 that has benefits over the prior art. The lug of the present illustrated invention provides firstly a means for lifting the wear plate during installation or replacement, and secondly a means for filling a hole in the wear plate, used for the passage of the coupling means, to thereby inhibit abrasion while the wear plate is installed within the bulk material handling device, such as the hopper or chute. The reader will now appreciate that the wear plate may be a hard faced wear plate or may be lined with generally flexible material such as rubber or polyurethane.

Various features of the invention have been particularly shown and described in connection with the exemplified embodiments of the invention, however, it must be understood that these particular arrangements merely illustrate and that the invention is not limited thereto. Accordingly the invention can include various modifications, which fall within the spirit and scope of the invention. It should be further understood that for the purpose of the specification the word "comprise" or "comprising" means "including but not limited to".

Claims defining the invention are as follows:

1. A lug reversibly connectable to a wear plate having a hole extending therethrough, the lug includes a coupling means and a plug, said plug comprising an upper surface, wherein in a first position the lug is connectable to an underside of the wear plate such that the coupling means extends through said hole and outward from an upper surface of the wear plate for engagement with a hoist, and in a second position the lug is connectable to the underside of said wear plate such that the plug fills said hole whereby the upper surface of the plug is aligned with the upper surface of the wear plate.

2. The lug of claim 1 including a base for connection to the underside of the wear plate, the coupling means extending outwardly from a first side of said base, and the plug attached to an opposite side of said base.

3. The lug of claim 2 wherein the base includes at least two slots or apertures that are configured to engage with fixing means that extend outwardly from the underside of the wear plate.

4. The lug of claim 3 wherein fixing means comprise a threaded stud that is connected to the wear plate, said slots or apertures of the base can be fitted over the threaded studs and correspondingly threaded nut can be fastened to the threaded studs to hold the lug in position.

5. The lug of claim 2 wherein the base is of a generally planar configuration with the coupling means being welded or otherwise fixed to a first planar side and the plug being welded or otherwise fixed to the opposite second planar side.

6. The lug of claim 2 wherein the base includes four slots or apertures, spaced apart around the circumference of the base, which slots or apertures are configured to engage with corresponding threaded studs that extend outwardly from the underside of the wear plate.

7. The lug of claim 6 wherein the configuration of the plate, with respect to the slots, is symmetrical whereby the slots or apertures align with the threaded studs when the lug is in the first position or in the second position.

8. The lug of claim 1 wherein the upper surface of the wear plate is wear resistant and the upper surface of the plug is wear resistant, wherein in said second position the wear resistant upper surface of the plug is aligned with the wear resistant upper surface of the wear plate.

9. The lug of claim 1 wherein the wear plate includes a rubber, ceramic or polyurethane upper layer and the plug includes a corresponding rubber, ceramic or polyurethane upper layer, wherein in said second position the upper surface of the plug is aligned with the upper surface of the wear plate to thereby provide a pliable load bearing surface.

10. The lug of claim 1 wherein the plug substantially fills said hole to thereby provide an least even, load bearing surface that inhibits abrasion as a material moves thereover.

11. The lug of claim 1 wherein the plug is constructed from the same material as the wear plate so that the plug abrades at the same rate as the wear plate.

12. The lug of claim 11 wherein the plug is cut from the wear plate to form said hole.

13. The lug of claim 1 wherein the hole in the wear plate is generally circular and the plug is correspondingly shaped to fit closely therein.

14. A wear plate having a hole and at least one reversible lug of claim 1.

15. A method of positioning a wear plate within a bulk material handling device using a lug, the lug including a coupling means and a plug, the method including the steps of:

attaching the lug to an underside of a wear plate adjacent a hole, wherein the coupling means extends through said hole and outwardly from an upper surface of said wear plate;

attaching a hoist to the coupling means and moving the wear plate so that said underside of the plate is positioned against an inner side of said handling device;

attaching the wear plate to said handling device;

detaching and reversing said lug; and reattaching the lug to said underside of the wear plate wherein the plug substantially fills said hole.

16. The method of claim 15 further including the steps of:

detaching and reversing the lug;

reattaching the lug to the underside of the wear plate wherein the coupling means extends through said hole and outwardly from said upper surface of the wear plate; and connecting a hoist to said coupling means and removing the wear plate from said bulk material handling device.

* * * * *